United States Patent [19]

Baumgartner

[11] 4,411,427

[45] Oct. 25, 1983

[54] BAT FOR PLAYING GAMES

[76] Inventor: Alfred Baumgartner, Rainstrasse 10, 8590 Romanshorn, Switzerland

[21] Appl. No.: 275,283

[22] Filed: Jun. 19, 1981

[30] Foreign Application Priority Data

Jun. 23, 1980 [GB] United Kingdom ..... 8020545

[51] Int. Cl.[3] ..... A63B 51/02

[52] U.S. Cl. ..... 273/67 R; 273/73 R; 273/76

[58] Field of Search ..... 273/67 R, 67 B, 73 R, 273/73 C, 73 F, 76

[56] References Cited

U.S. PATENT DOCUMENTS

| | | | |
|---|---|---|---|
| D. 226,206 | 1/1973 | Rankin et al. | 273/67 R X |
| 3,674,268 | 7/1972 | Shellman | 273/76 |
| 3,856,603 | 12/1974 | Schaefer et al. | 273/73 F X |
| 3,865,679 | 2/1975 | Hale | 273/67 R X |
| 3,879,035 | 4/1975 | Danchulis et al. | 273/73 C |
| 3,934,876 | 1/1976 | Haddad | 273/73 C |
| 4,079,935 | 3/1978 | Gormley | 273/67 R |
| 4,128,239 | 12/1978 | Grenadier | 273/67 R |

FOREIGN PATENT DOCUMENTS

| | | | |
|---|---|---|---|
| 493548 | 3/1930 | Fed. Rep. of Germany . | |
| 802060 | 5/1936 | France . | |
| 1594587 | 6/1970 | France . | |
| 607255 | 8/1948 | United Kingdom | 273/76 |
| 1242704 | 8/1971 | United Kingdom . | |

*Primary Examiner*—Anton O. Oechsle

*Attorney, Agent, or Firm*—Morgan, Finnegan, Pine, Foley & Lee

[57] ABSTRACT

The invention relates to a bat for use in beach tennis, volley tennis and tether tennis or similar games, the bat having a pair of striking surfaces at a distance apart and the space between the striking surfaces including a number of ribs which join the two striking surfaces, the surfaces being preferably of lattice structure and the ribs joining corresponding intersections of the lattices.

3 Claims, 7 Drawing Figures

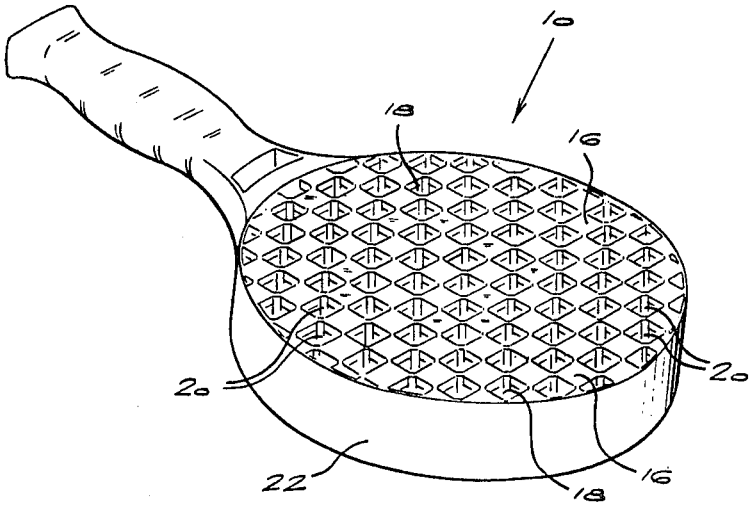
FIG 2A.
FIG 3
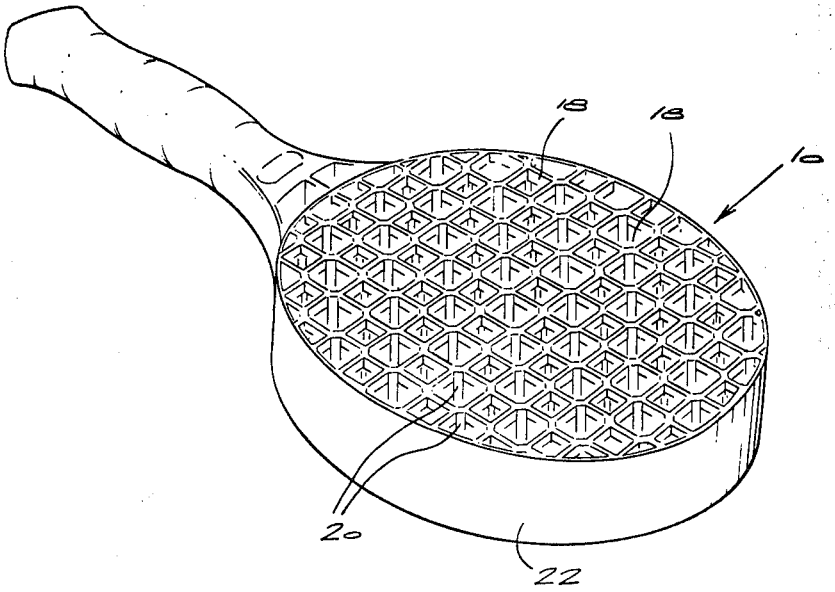

BAT FOR PLAYING GAMES

FIELD OF THE INVENTION

This invention relates to striking implements with unstressed perforated striking heads and in particular to bats used for games such as beach tennis, volley tennis, tether tennis or other similar games.

PRIOR ART

The prior art is replete with examples of bats useful for beach tennis and other games and the tendency recently has been to provide bats made from plastic material in which the frame, handle and head are integral. Some of these bats have perforated striking heads as opposed to unpierced striking heads and the present invention is not concerned with these latter bats. Nor is the present invention concerned with striking implements such as tennis or squash rackets in which the striking surfaces are stressed.

Prior art bats having perforated striking heads do not in Applicant's view provide adequate striking performance unless their rigidity can be increased substantially by increasing their thickness, but this can result in bats becoming excessively heavy.

Prior art discovered by the Applicant as a result of a search includes the following patents:

French Pat. No. 1,594,587 (Carlton Tyre) relates to unperforated bats and is regarded as being too thin for effective performance for games of the type envisaged;

U.S. Pat. No. 3,879,035 (Aluminium Company) concerns a pair of spaced apart unperforated striking faces having an aluminum honeycomb network therebetween and is therefore irrelevant to the field of the present invention;

French Pat. No. 802 060 (Lacoste) describes a table tennis bat having a plurality of orifices in the head and all surfaces are covered with rubber or the like. This bat is considered to be insufficiently rigid for effective performance of the type envisaged.

German Pat. No. 493 548 (Schubert) has longitudinal and transverse ribs which are joined with a central plate to form a laminate having both longitudinal and transverse spaces. The head is not perforated.

U K Pat. No. 1 242 704 is irrelevant in that it relates to coverings for table tennis bats.

OBJECT OF THE INVENTION

It is an object of the present invention to provide a perforated bat which provides excellent rigidity as well as having low air resistance while, at the same time being robust in construction and sufficiently light in mass for use by a variety of persons for a variety of games.

DEFINITIONS OF THE INVENTION

According to the present invention a bat includes a handle and head, the head including an unstressed monolithic perforated structure and having a pair of spaced-apart grid structures, the two outer surfaces of which constitute the striking surfaces and the inner surfaces being joined together by a plurality of discrete transverse struts between surface openings.

In this specification the term "grid structure" is intended to refer to structures thin in relation to lengths and breadths which are perforated by a series of openings of a variety of shapes. In a particular form of the invention the structure is a lattice comprising intersecting laths, which may be straight, curved or otherwise shaped and which may intersect at various angles.

In a preferred form of the invention the framework structures are formed by intersecting laths and are joined by means of struts spanning corresponding intersections of the laths.

Further according to the invention some of the interstices in the latticed striking surfaces may be webbed and it is further preferred that alternative interstices be webbed to constitute a chequered pattern.

DESCRIPTION OF A PREFERRED EMBODIMENT OF THE INVENTION

Embodiments of the invention are illustrated in the accompanying drawings in which:

FIG. 2A is a perspective of a similar bat,

FIG. 3 is a perspective view of an alternate form of a bat according to the invention and, FIGS. 4 to 6 are diagrammatic only and illustrate some of the various framework structures envisaged by the invention.

Figure 1:
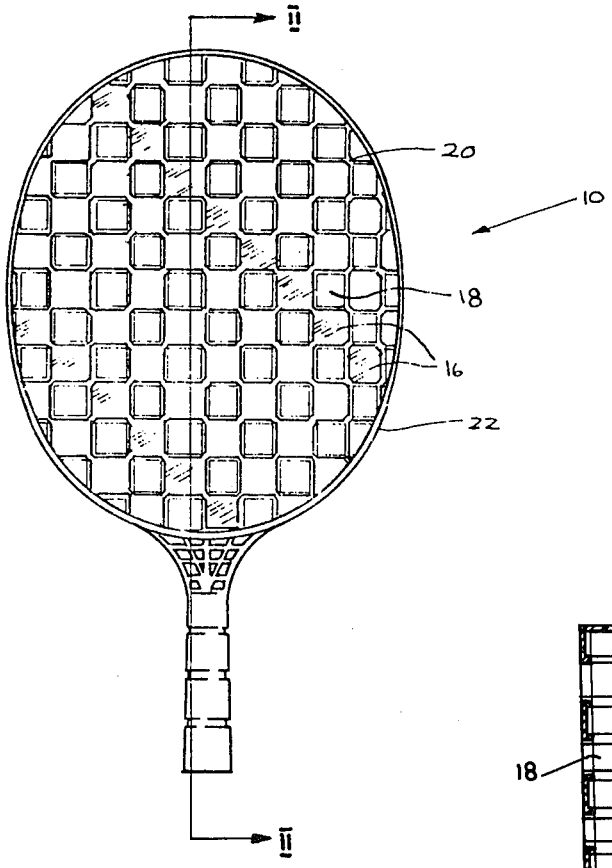
FIG. 1 is a frontal elevation of a bat according to the invention.
Figure 2:
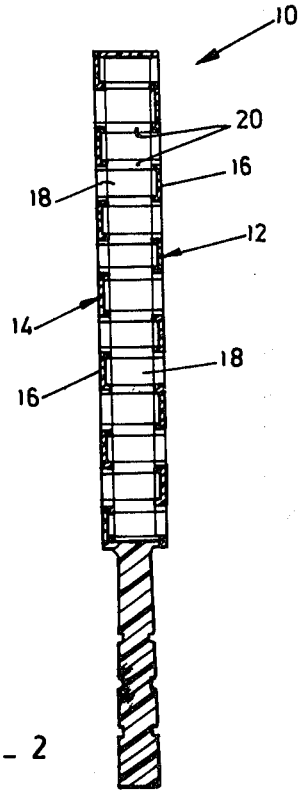
FIG. 2 is a section taken on line II—II in FIG. 1.

In FIGS. 1 and 2 a bat 10 comprises two spaced-apart striking surfaces indicated generally by reference numerals 12 and 14 each comprising a lattice, the alternate interstices of which are webbed with the polymeric material from which the bat 10 is moulded. This results in each face 12, 14 having a plurality of spaced apart webs 16 and voids 18, the web 16 on the one face being staggered with respect to those on the other face (as can be seen from FIG. 2). In the embodiments illustrated in FIGS. 1, 2 and 2A, the webs ae coplanar with the grid structures, and together therewith constitute the striking surfaces of the bat (see FIGS. 1 and 2).

The lattice structures of the faces 12,14 are connected one to another by means of transverse struts 20 integrally moulded therewith but which nevertheless constitute separate and discrete items. In fact the whole of the bat 10 may be integrally moulded to include the periphery 22 of the bat 10 as well as the handle 24, resulting in a monolithic structure light enough to be handled with ease.

The struts 20 are radiused inwardly where they connect with each lattice, thereby increasing the strength of the structure. Radiusing at the intersection of the lattice may also be provided so as further to strengthen the structure.

In FIG. 3 there is no webbing 16. Each face of the racket is formed by intersecting laths (not separately numbered) to define a lattice with voids 18. It will be appreciated that the intersections of the laths may be radiused, but this is not shown in the drawing for simplicity's sake.

Figure 4:
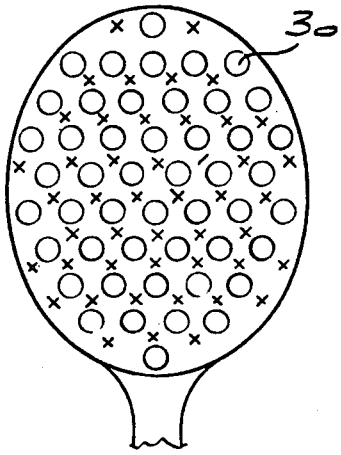
Figure 5:
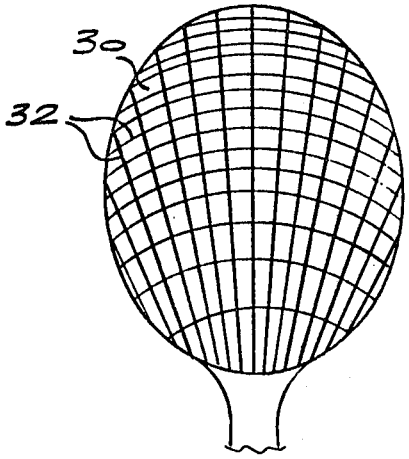
Figure 6:
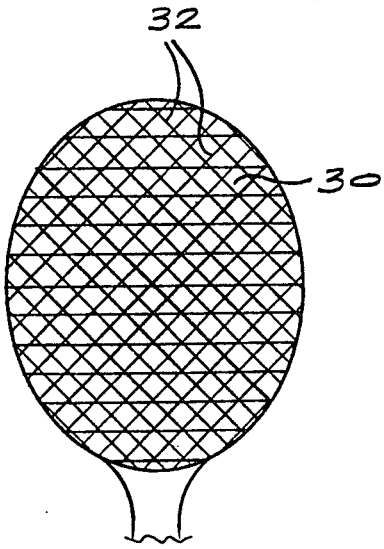

Referring now to FIGS. 4 to 6 it will be noted that the striking surfaces are generally planar and may be said to comprise series of openings 30, particularly in FIG. 4 whereas FIGS. 5 and 6 may be said to comprise lattices comprising intersecting laths 32 (but nevertheless still including openings 30).

Where possible the transverse struts (which extend into the paper) are indicated by crosses, joining the inner surfaces between surface openings.

I claim:

1. A bat for games including a handle and a head, the head including a monolithic unstressed perforated structure characterised by having a pair of spaced apart lattices, each comprised of a plurality of intersecting laths, the two outer surfaces of said lattices constituting the striking surfaces of the bat, the inner surfaces of said lattices being interconnected by a plurality of discrete struts spanning corresponding intersections only of the laths comprising said lattices.

2. A bat for games including a handle and a head, the head including a monolithic unstressed perforated structure characteristised by having a pair of spaced apart grid structures, some of the interstices of each grid structure having integral coplanar webs, the two outer surfaces of the grid structures and the webs constituting the striking surfaces and the inner surfaces being joined by a plurality of discrete struts spanning corresponding intersections of the grid structures.

3. The bat according to claim 2 characterised in that the webbed interstices are in a chequered pattern, with the webs on one face being staggered with respect to those on the other face.

* * * * *